US009976472B2

(12) United States Patent
Bilancia et al.

(10) Patent No.: US 9,976,472 B2
(45) Date of Patent: May 22, 2018

(54) METHOD OF CONTROLLING A COOLING CIRCUIT OF AN INTERNAL COMBUSTION ENGINE

(71) Applicant: GM GLOBAL TECHNOLOGY OPERATIONS LLC, Detroit, MI (US)

(72) Inventors: Michele Bilancia, Turin (IT); Simone Barbero, Turin (IT); Simone Bambagioni, Turin (IT); Salvatore Mafrici, Turin (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 166 days.

(21) Appl. No.: 15/019,469

(22) Filed: Feb. 9, 2016

(65) Prior Publication Data

US 2016/0230642 A1 Aug. 11, 2016

(30) Foreign Application Priority Data

Feb. 9, 2015 (GB) ..... 1502091.0

(51) Int. Cl.

| | |
|---|---|
| ***F01P 7/14*** | (2006.01) |
| ***F01P 11/16*** | (2006.01) |
| ***F01P 11/14*** | (2006.01) |
| ***F01P 7/16*** | (2006.01) |

(52) U.S. Cl.

CPC ..... *F01P 7/167* (2013.01); *F01P 7/164* (2013.01); *F01P 2007/146* (2013.01); *F01P 2025/62* (2013.01); *F01P 2025/66* (2013.01)

(58) Field of Classification Search

CPC ..... F01P 7/167; F01P 7/164; F01P 2007/146; F01P 2025/62; F01P 2025/66

USPC ..... 123/41.05, 41.13, 41.08; 137/1; 236/34

See application file for complete search history.

(56) References Cited

U.S. PATENT DOCUMENTS

| | | | | |
|---|---|---|---|---|
| 6,758,172 | B2 | 7/2004 | Morgan et al. | |
| 6,810,838 | B1 | 11/2004 | Hellman | |
| 9,726,068 | B2 * | 8/2017 | Murai | F01P 7/16 |
| 2002/0195067 | A1 * | 12/2002 | Murakami | F01P 3/20 123/41.1 |
| 2003/0047149 | A1 * | 3/2003 | Shinpo | F01P 7/167 123/41.1 |
| 2004/0016411 | A1 | 1/2004 | Joyce et al. | |
| 2006/0005790 | A1 * | 1/2006 | Braun | F01P 7/167 123/41.08 |
| 2010/0083916 | A1 * | 4/2010 | Shintani | F01P 7/164 123/41.1 |
| 2011/0214627 | A1 * | 9/2011 | Nishikawa | F01P 7/04 123/41.02 |

(Continued)

OTHER PUBLICATIONS

Great Britain Patent Office, Great Britain Search Report for Great Britain Application No. 1502091.0, dated Aug. 12, 2015.

*Primary Examiner* — Lindsay Low
*Assistant Examiner* — John Bailey
(74) *Attorney, Agent, or Firm* — Lorenz & Kopf LLP

(57) ABSTRACT

A method of operating a cooling circuit of an internal combustion engine is disclosed. The engine is equipped with an engine head, and the cooling circuit includes a pump configured to deliver a variable flow of coolant through the cooling circuit. A coolant flow rate to be delivered by the pump is calculated as a function of an engine load, an engine speed and a desired engine head temperature, and the pump is operated to deliver the calculated coolant flow rate.

20 Claims, 6 Drawing Sheets

(56) References Cited

U.S. PATENT DOCUMENTS

| | | | | |
|---|---|---|---|---|
| 2015/0176472 | A1 | 6/2015 | Hutchins et al. | |
| 2017/0107891 | A1* | 4/2017 | Murai | F01P 7/16 |

* cited by examiner

METHOD OF CONTROLLING A COOLING CIRCUIT OF AN INTERNAL COMBUSTION ENGINE

CROSS-REFERENCE TO RELATED APPLICATION

This application claims priority to Great Britain Patent Application No. 1502091.0, filed Feb. 9, 2015, which is incorporated herein by reference in its entirety.

TECHNICAL FIELD

The present disclosure relates to a method of controlling a cooling circuit of an internal combustion engine.

BACKGROUND

It is known that internal combustion engines are equipped with a cooling system. The cooling system is generally provided for cooling down the internal combustion engine, as well as other engine fluids, such as for example the exhaust gas in the EGR cooler and/or the lubricating oil in the oil cooler. The cooling system schematically includes a coolant pump that delivers a coolant, typically a mixture of water and antifreeze, from a coolant tank to a plurality of cooling channels internally defined by the engine block and engine head. The coolant pump is generally integrated in the internal combustion engine and is a fixed flow pump including a moving component, typically an impeller, which is accommodated in a seat realized in the engine block and delivers the coolant directly in the cooling channels. The coolant pump is also associated with a thermostatic valve and it is activated or deactivated as a function of the temperature measured by the thermostatic valve.

After passing through these cooling channels, the coolant is directed to the EGR cooler, to the oil cooler and possibly to other heat exchangers of the motor vehicle, such as for example a cabin heater and/or an electric machinery cooler. Finally, the coolant is cooled down in a radiator and routed back into the coolant tank. A problem of these cooling systems is that, due to the ON/OFF switching of the pump, the temperature of the engine is not always optimal and excessive fuel consumption may arise.

SUMMARY

In accordance with the present disclosure a cooling circuit of an internal combustion engine is controlled in a manner that calculates and delivers the required coolant flow rate required to cool down the engine in view of minimizing fuel consumption. In particular, a method, an apparatus, an automotive system, a computer program and a computer program product is disclosed herein. In an embodiment of the disclosure, a method of operating a cooling circuit of an internal combustion engine is disclosed. The engine is equipped with an engine head, and the cooling circuit includes a pump configured to deliver a variable flow of coolant through the cooling circuit. A coolant flow rate to be delivered by the pump is calculated as a function of an engine load, an engine speed and a desired engine head temperature. The pump is operated to deliver the coolant flow rate. An effect of this embodiment is that an open loop control of the flow rate of the pump is created in order to quickly react to transient engine operating conditions.

According to another embodiment of the present disclosure, the cooling circuit includes a rotary valve configured to direct a coolant flow through a radiator in the cooling circuit. A percentage of aperture of the rotary valve is calculated as a function of an engine load, an engine speed and a desired engine inlet temperature. The rotary valve is operated with the calculated percentage of aperture. An effect of this embodiment is that the control of the engine temperature is improved by operating the rotary valve when the temperature rises over a predetermined threshold.

According to a further embodiment of the present disclosure, the calculated coolant flow rate to be delivered by the pump is corrected with a term representative of a percentage of aperture of the rotary valve. An effect of this embodiment is to improve the temperature control taking into account the effect of the coolant passing through the radiator.

According to a further embodiment of the present disclosure, the calculated coolant flow rate to be delivered by the pump is corrected with a term representative of a difference between the desired engine head temperature and a measured engine head temperature. An effect of this embodiment is to correct the flow rate taking account also of significant temperature differences.

According to still another embodiment of the present disclosure, the calculated percentage of aperture of the rotary valve is corrected with a term representative of a coolant flow rate delivered by the pump. An effect of this embodiment is that improved temperature control is achieved taking into account the effect of the coolant flow rate delivered by the pump.

According to another embodiment of the present disclosure, the calculated percentage of aperture of the rotary valve is corrected with a term representative of a difference between the desired engine inlet temperature and a measured engine inlet temperature. An effect of this embodiment is to correct the effects of the rotary valve directing the coolant into the radiator taking account also of significant temperature differences.

According to another embodiment of the present disclosure, the method further includes measuring an engine head temperature, correcting the calculated coolant flow rate with a correction flow rate value determined as a function of a difference between a desired engine head temperature and the measured engine head temperature to obtain a corrected flow rate value, and operating the pump to deliver the corrected coolant flow rate. An effect of this embodiment is that it allows to fine tune the temperature control by means of a closed loop control suitable to react to take into account engine and environmental thermal transient conditions.

According to still another embodiment of the present disclosure, the method includes measuring an engine inlet temperature, correcting the calculated percentage of aperture of the rotary valve with a correction percentage of aperture of the rotary valve determined as a function of a difference between a desired engine inlet temperature and the measured engine inlet temperature to obtain a corrected percentage of aperture of the rotary valve, and opening the rotary valve with the corrected percentage of aperture. An effect of this embodiment is that it improves the closed loop control of the temperature.

According to still another embodiment of the present disclosure, the correction flow rate value of the pump is determined by means of a proportional-integrative (PI) control in which the coefficients of the proportional and of the integrative terms are variable as a function of engine operating conditions. An effect of this embodiment is to adapt the proportional-integrative (PI) control of the pump to different engine and environment conditions.

According to still another embodiment of the present disclosure, the correction percentage of aperture of the rotary valve is determined by means of a proportional-integrative (PI) control in which the coefficients of the proportional and of the integrative terms are variable as a function of engine operating conditions. An effect of this embodiment is to adapt the proportional-integrative (PI) control of the rotary valve to different engine and environment conditions.

Another embodiment of the present disclosure provides an apparatus for operating a cooling circuit of an internal combustion engine, the engine being equipped with an engine head, the cooling circuit including a pump configured to deliver a variable flow of coolant through the cooling circuit, and an electronic control unit configured with programmed instructions to carry out the method described above.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
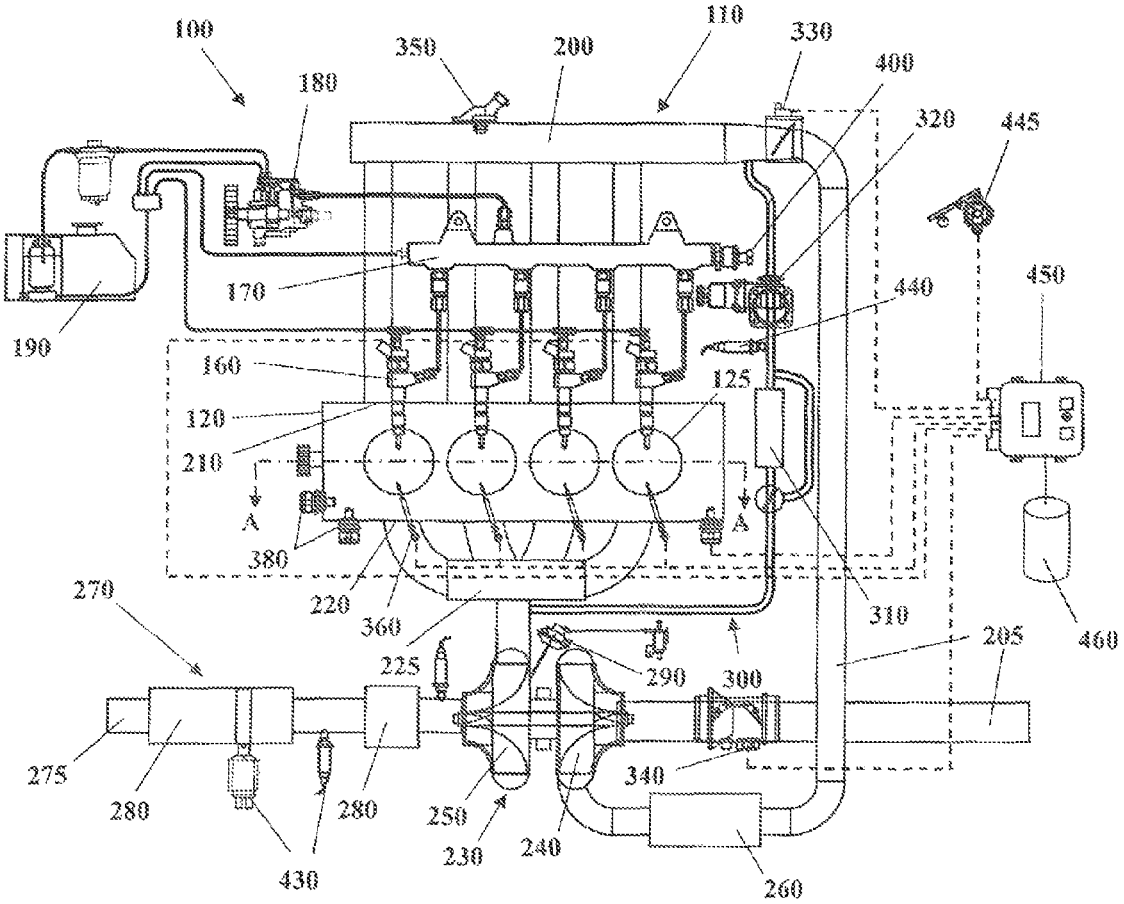
FIG. 1 shows an automotive system.
Figure 2:
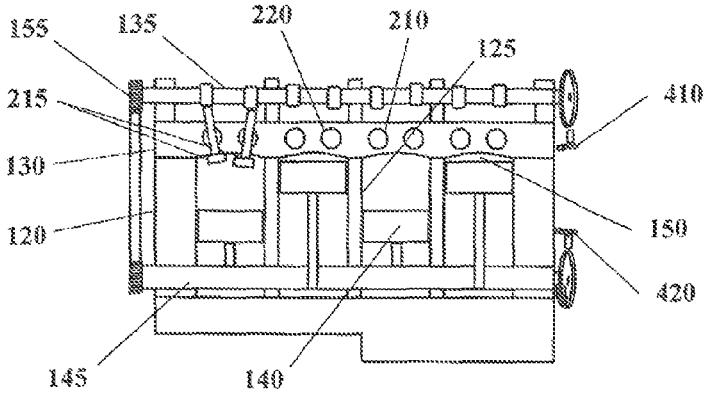
FIG. 2 is a cross-section of an internal combustion engine belonging to the automotive system of FIG. 1.

Some embodiments may include an automotive system 100, as shown in FIGS. 1 and 2, that includes an internal combustion engine (ICE) 110 having an engine block 120 defining at least one cylinder 125 having a piston 140 coupled to rotate a crankshaft 145. An engine head 130 cooperates with the piston 140 to define a combustion chamber 150. A fuel and air mixture (not shown) is disposed in the combustion chamber 150 and ignited, resulting in hot expanding exhaust gasses causing reciprocal movement of the piston 140. The fuel is provided by at least one fuel injector 160 and the air through at least one intake port 210. The fuel is provided at high pressure to the fuel injector 160 from a fuel rail 170 in fluid communication with a high pressure fuel pump 180 that increases the pressure of the fuel received from a fuel source 190. Each of the cylinders 125 has at least two valves 215, actuated by a camshaft 135 rotating in time with the crankshaft 145. The valves 215 selectively allow air into the combustion chamber 150 from the port 210 and alternately allow exhaust gases to exit through a port 220. In some examples, a cam phaser 155 may selectively vary the timing between the camshaft 135 and the crankshaft 145.

The air may be distributed to the air intake port(s) 210 through an intake manifold 200. An air intake duct 205 may provide air from the ambient environment to the intake manifold 200. In other embodiments, a throttle body 330 may be provided to regulate the flow of air into the manifold 200. In still other embodiments, a forced air system such as a turbocharger 230, having a compressor 240 rotationally coupled to a turbine 250, may be provided. Rotation of the compressor 240 increases the pressure and temperature of the air in the duct 205 and manifold 200. An intercooler 260 disposed in the duct 205 may reduce the temperature of the air. The turbine 250 rotates by receiving exhaust gases from an exhaust manifold 225 that directs exhaust gases from the exhaust ports 220 and through a series of vanes prior to expansion through the turbine 250. The exhaust gases exit the turbine 250 and are directed into an exhaust system 270. This example shows a variable geometry turbine (VGT) with a VGT actuator 290 arranged to move the vanes to alter the flow of the exhaust gases through the turbine 250. In other embodiments, the turbocharger 230 may be fixed geometry and/or include a waste gate.

The exhaust gases of the engine are directed into an exhaust system 270. The exhaust system 270 may include an exhaust pipe 275 having one or more exhaust aftertreatment devices 280. The aftertreatment devices may be any device configured to change the composition of the exhaust gases. Some examples of aftertreatment devices 280 include, but are not limited to, catalytic converters (two and three way), oxidation catalysts, lean $NO_x$ traps, hydrocarbon adsorbers, selective catalytic reduction (SCR) systems, and particulate filters. Other embodiments may include an exhaust gas recirculation (EGR) system 300 coupled between the exhaust manifold 225 and the intake manifold 200. The EGR system 300 may include an EGR cooler 310 to reduce the temperature of the exhaust gases in the EGR system 300. An EGR valve 320 regulates a flow of exhaust gases in the EGR system 300.

The automotive system 100 may further include an electronic control unit (ECU) 450 in communication with one or more sensors and/or devices associated with the ICE 110 and with a memory system, or data carrier 460, and an interface bus. The ECU 450 may receive input signals from various sensors configured to generate the signals in proportion to various physical parameters associated with the ICE 110. The sensors include, but are not limited to, a mass airflow and temperature sensor 340, a manifold pressure and temperature sensor 350, a combustion pressure sensor 360, coolant and oil temperature and level sensors 380, a fuel rail pressure sensor 400, a cam position sensor 410, a crank position sensor 420, exhaust pressure and temperature sensors 430, an EGR temperature sensor 440, and an accelerator pedal position sensor 445. Furthermore, the ECU 450 may generate output signals to various control devices that are arranged to control the operation of the ICE 110, including, but not limited to, the fuel injectors 160, the throttle body 330, the EGR Valve 320, a Variable Geometry Turbine (VGT) actuator 290, and the cam phaser 155. Note, dashed lines are used to indicate communication between the ECU 450 and the various sensors and devices, but some are omitted for clarity.

Turning now to the ECU 450, this apparatus may include a digital central processing unit (CPU) in communication with a memory system, or data carrier 460, and an interface bus. The CPU is configured to execute instructions stored as a program in the memory system, and send and receive signals to/from the interface bus. The memory system may include various storage types including optical storage, magnetic storage, solid state storage, and other non-volatile memory. The interface bus may be configured to send, receive, and modulate analog and/or digital signals to/from the various sensors and control devices. The program may embody the methods disclosed herein, allowing the CPU to carry out the steps of such methods and control the ICE 110.

The program stored in the memory system is transmitted from outside via a cable or in a wireless fashion. Outside the automotive system 100 it is normally visible as a computer program product, which is also called computer readable medium or machine readable medium in the art, and which should be understood to be a computer program code residing on a carrier, said carrier being transitory or non-transitory in nature with the consequence that the computer program product can be regarded to be transitory or non-transitory in nature.

An example of a transitory computer program product is a signal, e.g. an electromagnetic signal such as an optical signal, which is a transitory carrier for the computer program code. Carrying such computer program code can be achieved by modulating the signal by a conventional modulation technique such as QPSK for digital data, such that binary data representing said computer program code is impressed on the transitory electromagnetic signal. Such signals are e.g. made use of when transmitting computer program code in a wireless fashion via a Wi-Fi connection to a laptop.

In case of a non-transitory computer program product the computer program code is embodied in a tangible storage medium. The storage medium is then the non-transitory carrier mentioned above, such that the computer program code is permanently or non-permanently stored in a retrievable way in or on this storage medium. The storage medium can be of conventional type known in computer technology such as a flash memory, an Asic, a CD or the like.

Instead of an ECU 450, the automotive system 100 may have a different type of processor to provide the electronic logic, e.g. an embedded controller, an onboard computer, or any processing module that might be deployed in the vehicle.

Figure 3:
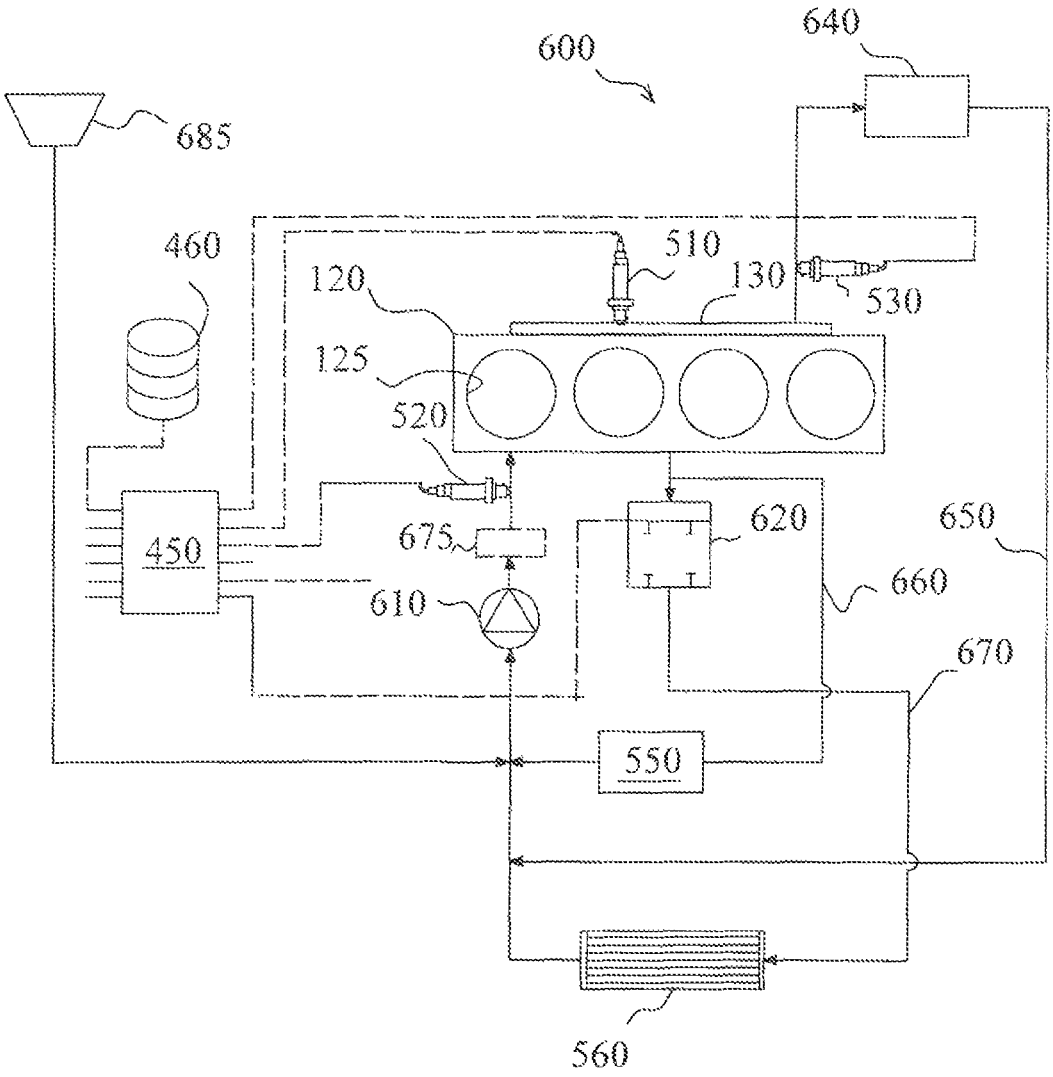
FIG. 3 is a schematic representation of some components of the automotive system of FIG. 1.

Referring now to FIG. 3, internal combustion engine 110 has an engine head temperature sensor 510 which reads the engine head 130 metal temperature (also referred as MTS in the present description). In more general terms, the parameter MTS can be expressed by a sensor that measures the coolant temperature (not represented for simplicity) or, as stated above, in terms of temperature sensor 510 which reads the engine head 130 metal temperature. The internal combustion engine 110 is also equipped with an engine inlet temperature sensor 520 and with an engine outlet temperature sensor 530.

Furthermore, the internal combustion engine 110 is equipped with a cooling system equipped with a cooling circuit 600, provided for cooling down the internal combustion engine 110 and the lubricating oil in an oil cooler 550. The cooling circuit 600 includes a coolant pump 610 that delivers a coolant, typically a mixture of water and anti-freeze, from a coolant tank 685 to a plurality of cooling channels (not represented for simplicity) internally defined by the engine block 120 and by the engine head 130. The coolant pump 610 maybe a variable flow pump or, in some embodiments of the present disclosure, a fixed flow pump coupled to a control valve 675 (represented in dashed lines in FIG. 4), the control valve 675 being used to adjust the flow exiting from the pump. Therefore, in the various embodiments of the method, the pump 610 can deliver a flow rate %_WP that is variable from 0% to 100%.

Furthermore, the cooling circuit 600 includes a rotary valve 620 that intercepts a branch 670 of the cooling circuit 600. In the various embodiments of the method, the rotary valve 620 can be opened for a variable percentage from 0% (rotary valve 620 fully closed) to 100% rotary valve 620 fully open). When the rotary valve 620 is closed, but the pump 610 is activated, the pump 610 delivers the coolant directly in the cooling channels and, after passing through the cooling channels, the coolant is directed to additional heat exchangers 640, through a branch 650 of cooling circuit 600, and in an oil cooler 550, through a branch 660 of cooling circuit 600. When the rotary valve 620 is open, the pump 610 delivers the coolant towards a radiator 560 to be cooled down and routed back into the coolant tank 685.

The operations of the pump 610 and of the rotary valve 620 are controlled by the ECU 450 according to a computer program stored in the data carrier 460 and following the various embodiments of the present disclosure.

Figure 4:
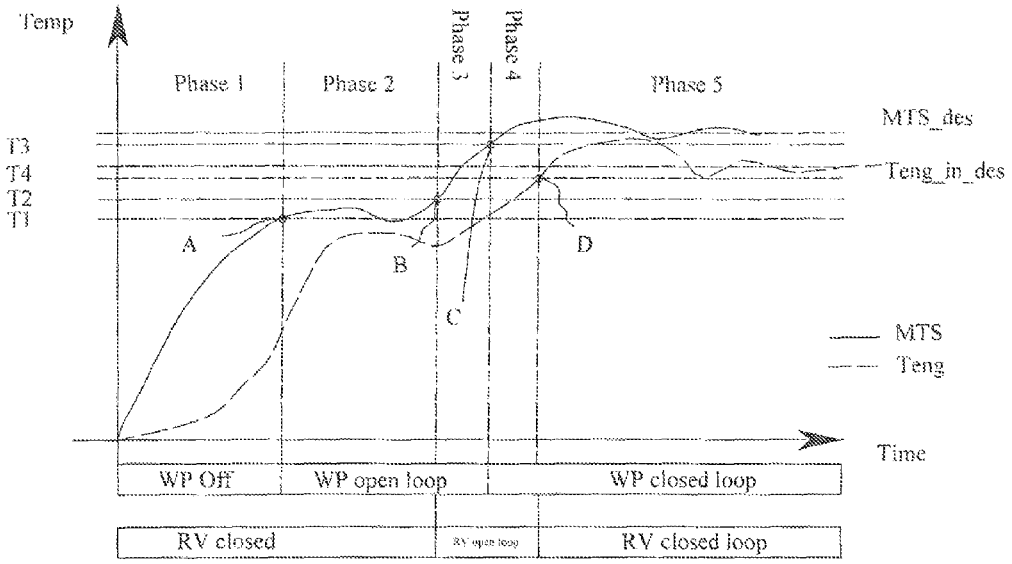
FIG. 4 is a graph representing the engine head and engine temperature over time as a function of various phases of the embodiments of the present disclosure.

FIG. 4 is a graph representing the engine head temperature MTS (continuous line A) and the engine inlet temperature Teng_In (dashed line B) over time, in order to describe the various phases of the embodiments of the present disclosure. In a first phase (Phase 1 in FIG. 4) the engine 110 has just started so that both the engine head temperature MTS and the engine inlet temperature Teng_in are low and, therefore, the pump 610 is maintained off and the rotary valve 620 is maintained closed, because there is no need to cool down the engine 110. Once the engine head temperature MTS, as measured by the respective engine head temperature sensor 510, reaches a predefined temperature threshold T1 (point A of FIG. 4), the pump 610 is activated and is controlled in a feed forward mode, while the rotary valve 620 remains closed (Phase 2).

In this phase the feed forward control is calibrated in such a way that a target coolant flow rate is reached, as a function of a target engine head temperature MTS_des. In other words, a coolant flow rate %_WP_FF for the variable flow pump 610 is calculated. Such flow rate can be expressed as a percentage varying from 0% (pump 610 deactivated) to 100% (pump 610 fully operative). In this phase, until the engine head temperature MTS remains low, the coolant flowrate, function of engine head temperature MTS, is maintained low in order to have a fast warm-up. As the engine head temperature MTS increases, the coolant flow rate %_WP_FF increases to reach calibrated values.

When the engine head temperature MTS reaches a second predefined temperature threshold T2 (start of Phase 3-point B of FIG. 4), the pump 610 is still controlled in a feed forward mode in order to deliver a coolant flow rate %_WP_FT, while the rotary valve 620 is opened for a percentage of aperture %_RV_FF. The percentage of aperture %_RV_FF is calibrated in order to reach a target coolant flowrate requested for the target engine inlet temperature Teng_in_des. In this phase, until the engine inlet temperature Teng_in remains low, a dedicated vector, function of engine inlet temperature Teng_in, will lower the percentage of aperture %_RV_IT of the rotary valve 620 so to have a fast warm-up. As engine inlet temperature Teng_In increases, this vector will let the percentage of aperture %_RV_FF of the rotary valve 620 increase to calibrated values.

When the engine head temperature MTS reaches a third predefined temperature threshold T3 (start of Phase 4-point C of FIG. 4), a closed loop control of the pump 610 is added to the feed forward control of the pump 610 in order to maintain an engine head temperature MTS close to the target engine head temperature MTS_des. In Phase 4 the rotary valve 620 is still controlled only in open loop.

Finally, when the engine inlet temperature Teng_in reaches a fourth predefined temperature threshold T4 (start of Phase 5-point D of FIG. 4), a closed loop control of the rotary valve 620 is added to the feed forward control of the rotary valve 620, in order to maintain an engine inlet temperature Teng_in close to the target engine inlet temperature Teng_in_des.

Figure 5:
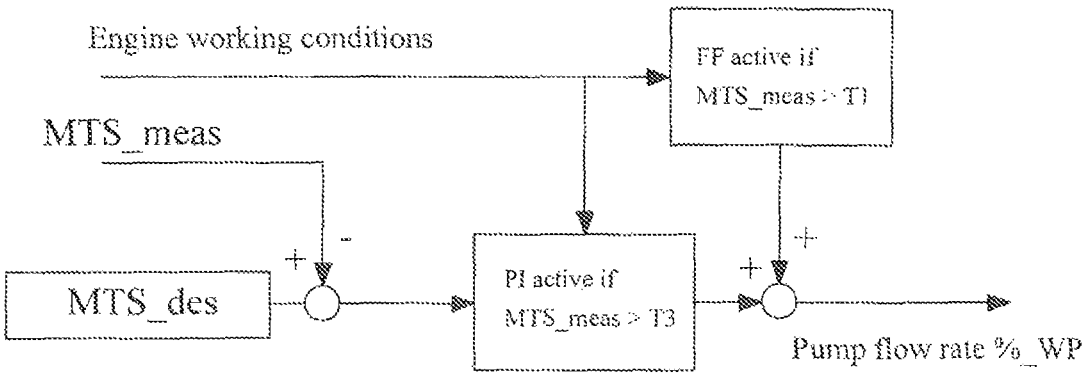
FIG. 5 is a flowchart representing schematically a controller structure for a variable pump, according to an embodiment of the present disclosure.

FIG. 5 is a flowchart representing schematically a controller structure for the variable pump 610, according to an embodiment of the present disclosure. In this case, an engine head temperature MTS_meas is measured, for example by means of engine head temperature sensor 510 and, if the measured engine head temperature MTS_meas is greater than the temperature threshold T1 for activating feed forward control of pump 610, the feed forward control of pump 610 is activated.

The temperature threshold T1 for activating feed forward control of pump 610 may be a function of engine conditions, as better explained hereinafter. If the measured engine head temperature MTS_meas is greater than the temperature threshold T3 for activating closed loop control of pump 610, a proportional integrative (PI) closed loop control of pump 610 is activated and added to the feed forward control of pump 610

Figure 6:
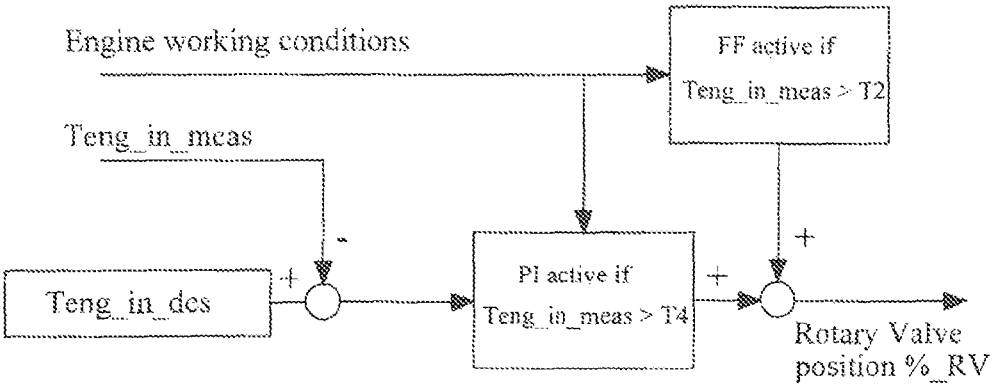
FIG. 6 is a flowchart representing schematically a controller structure for a rotary valve, according to an embodiment of the present disclosure.

FIG. 6 is a flowchart representing schematically a controller structure for a rotary valve, according to an embodiment of the present disclosure, such controller structure being substantially similar to the one described with reference to FIG. 5. An engine inlet temperature Teng_in_meas is measured, for example by means of engine inlet temperature sensor 520 and, if the measured engine inlet temperature Teng_in_meas is greater than the threshold temperature T2 for activating feed forward control of rotary valve 620, the feed forward control of the aperture of the rotary valve 620 is activated. The temperature threshold T2 for activating feed forward control of rotary valve 620 may be a function of engine conditions, as better explained hereinafter, if the measured engine inlet temperature Teng_in_meas is greater than the threshold temperature T4 for activating closed loop control of rotary valve 620, a proportional integrative (PI) closed loop control of the aperture of the rotary valve 620 is activated and added to the feed forward control of the aperture of the rotary valve 620.

Figure 7:
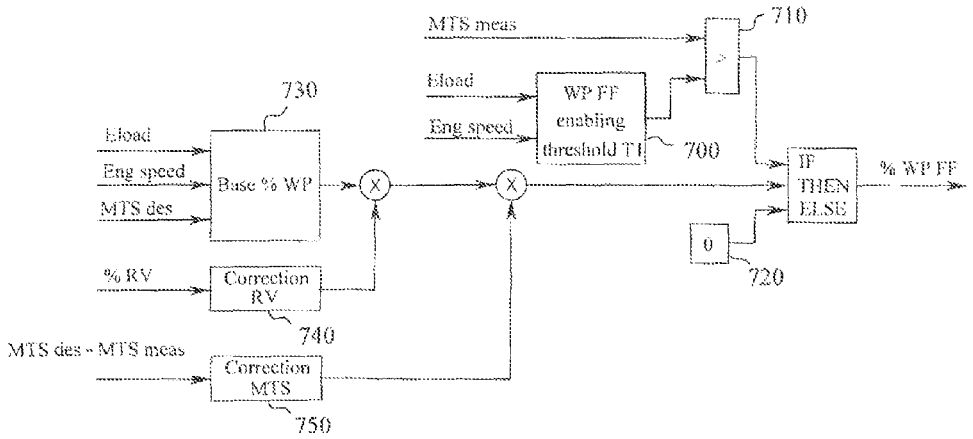
FIG. 7 is a flowchart representing in more detail the controller structure of FIG. 5.

FIG. 7 is a flowchart representing in more detail the controller structure of FIG. 5. In block 700, the temperature threshold T1 for activating feed forward control of pump 610 is defined as a function of the fuel consumption fuel, namely the quantity of fuel injected into the cylinders 125 of the engine 110, expressed for example in $mm^3$, and in terms of engine speed (Espeed). In more general terms, instead of the fuel consumption fuel parameter, an engine load Eload can be considered. In other implementations of the method, the engine load can be expressed in term of torque delivered by the engine or, as stated above, in terms of fuel consumption.

The engine head temperature MTS_meas measured by sensor 510 is compared with the temperature threshold T1 (block 710) and, if the engine head temperature MTS_meas is greater than the temperature threshold T1, then the coolant pump 610 is activated. On the contrary, if the condition expressed in block 710 is not verified, the coolant pump 610 is not activated (block 720). A map 730, stored in the data carrier 460 associated with the ECU 450, is used to calculate the feed forward value of the pump 610 flow rate %_WP_FE Map 730 is a 3D map which outputs the feed forward contribution of the pump 610 flow rate %_WP_FF as a function of the quantity of fuel injected into the cylinders 125 of the engine 110, of engine speed and of the target engine head temperature MTS_des. In some software implementations, such 3D map 730 can be expressed as a suitable combination of 2D maps.

Since in some implementations of the method, in particular when the measured engine inlet temperature Teng_in_meas is greater than the temperature threshold T2, the rotary valve 620 is activated, the feed forward value of the pump 610 flow rate %_WP_FE may be corrected with a term representative of a percentage of aperture of the rotary valve 620 (block 740). Optionally, the feed forward value of the pump flow rate %_WP_FF may further be corrected with a term representative of a difference between the target engine head temperature MTS_des and the measured engine head temperature MTS_meas (block 750).

Figure 8:
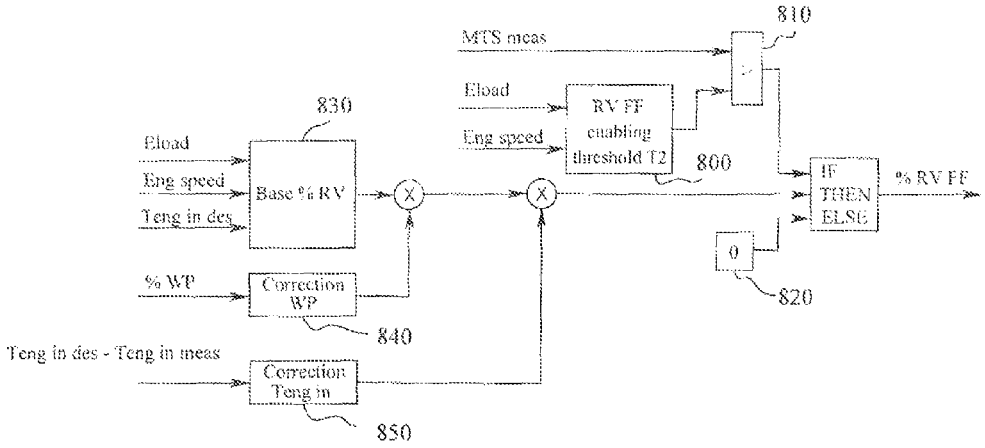
FIG. 8 is a flowchart representing in more detail the controller structure of FIG. 6.

FIG. 8 is a flowchart representing in more detail the controller structure of FIG. 6. In block 800, the temperature threshold T2 for activating teed forward control of aperture of the rotary valve 620 is defined as a function of the fuel consumption fuel, namely the quantity of fuel injected into the cylinders 125 of the engine 110, expressed for example in $mm^3$, and in terms of engine speed Espeed. Also in this case, in more general terms, instead of the fuel consumption fuel parameter, an engine load Eload can be considered. In other implementations of the method, the engine load can be expressed in term of torque delivered by the engine or, as stated above, in terms of fuel consumption.

The measured engine head temperature MTS_meas is compared with the temperature threshold T2 (block 810) and, if such temperature is greater than the temperature threshold T2, then the coolant pump 610 is activated. On the contrary, if the condition expressed in block 810 is not verified the rotary valve 620 remains closed (block 820).

A map 830, stored in the data carrier 460 associated with the ECU 450, is used to calculate the feed forward aperture of the rotary valve 620 %_RV_FF. Map 830 is a 3D map which outputs the feed forward contribution of the aperture of the rotary valve 620 as a function of the quantity of fuel injected into the cylinders 125 of the engine 110, of engine speed and of the target engine inlet temperature Teng_in_des.

In some software implementations, such 3D map 830 can be expressed as a suitable combination of 2D maps.

Since in some implementations of the method, in particular when the measured engine head temperature MTS_meas is greater than the temperature threshold T1, the pump 610 is activated, the feed forward value of the aperture of the rotary valve 620 %_RV_FF may be corrected with a term representative of a pump flow rate %_WP_FF (block 840). Optionally, the feed forward value of the aperture of the rotary valve %_RV_FF may further be corrected with a term representative of a difference between the target engine inlet temperature Teng_in_des and the measured engine inlet temperature Teng_in_meas (block 850).

The proportional integrative (PI) closed loop control of the pump 610 can be implemented simply by measuring the engine head temperature MTS and comparing it with the target engine head temperature MTS_des and reducing the pump 610 flow rate is such target is not reached or by increasing the pump 610 flow rate if the measured engine head temperature MTS_meas exceeds the target engine head temperature MTS_des. In other words, the calculated coolant flow rate %_WP_FF is corrected with a correction flow rate value %_WP_Corr, determined as a function of the difference between a desired engine head temperature MTS_des and the measured engine head temperature MTS_meas, to obtain a corrected flow rate value %_WP_PI. Then the pump 610 is operated to deliver the corrected coolant flow rate %_WP_PI.

In a similar fashion, the proportional integrative (PI) closed loop control of the aperture of the rotary valve 620 can be implemented by measuring the engine inlet temperature and comparing it with the target engine inlet temperature Teng_in_des and reducing the rotary valve aperture if such target temperature is not reached or by increasing the rotary valve aperture if the measured engine inlet temperature Teng_in_meas exceeds the target engine inlet temperature Teng_in_des. In other words, the calculated percentage of aperture %_RV_FF of the rotary valve 620 is corrected with a correction percentage of aperture %_RV_Corr of the rotary valve 620 determined as a function of a difference between the desired engine inlet temperature Teng_in_des and the measured engine inlet temperature Teng_in_meas to obtain a corrected percentage of aperture %_RV_PI of the rotary valve 620. Then the rotary valve 620 is opened with the corrected percentage of aperture %_RV_PI.

In one or both of the PI closed loop control procedures, respectively for the pump 610 flowrate and for the aperture of the rotary valve 620, anti-windup techniques may be applied. In one or both of the PI closed loop control procedures, respectively for the pump 610 flowrate and for the aperture of the rotary valve 620, the coefficients of the proportional and of the integrative terms can be variable as a function of engine operating conditions.

In particular, for the pump 610 PI control, the relevant engine operating conditions are the fuel consumption rate fuel, the engine speed Espeed and the difference between the desired engine head temperature MTS_des and the measured engine head temperature MTS_meas. Moreover, for the rotary valve 620 PI control, the relevant engine operating conditions are the fuel consumption rate fuel, the engine speed Espeed and the difference between the desired engine inlet temperature Teng_in_des and the measured engine inlet temperature Teng_in_meas.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A method of operating a cooling circuit of an internal combustion engine having an engine head, wherein a pump of the cooling circuit is configured to deliver a variable coolant flow rate through the cooling circuit, the method comprising:

receiving input signals indicating an engine speed and an engine load;

calculating a target coolant flow rate to be delivered by the pump as a function of the engine load, the engine speed and a desired temperature of the engine head; and controlling the pump to deliver the target coolant flow rate through the cooling circuit.

2. The method according to claim 1, wherein a rotary valve of the cooling circuit is configured to direct a coolant flow through a radiator in the cooling circuit, the method further comprising:

calculating a target position for the rotary valve as a function of an engine load, an engine speed and a desired engine inlet temperature, wherein the target position is defined in terms of a percentage of aperture of the rotary valve;

positioning the rotary valve into the target position to direct at least a portion of the coolant flow through the rotary valve to the radiator.

3. The method according to claim 2, further comprising correcting the target coolant flow rate to be delivered by the pump as a function of the target position of the rotary valve.

4. A method of operating a cooling circuit of an internal combustion engine having an engine head, wherein a pump of the cooling circuit is configured to deliver a variable coolant flow rate through the cooling circuit and a rotary valve of the cooling circuit is configured to direct a coolant flow through a radiator in the cooling circuit, the method comprising:

calculating a target coolant flow rate to be delivered by the pump as a function of the engine load, the engine speed and a desired temperature of the engine head; and controlling the pump to deliver the target coolant flow rate through the cooling circuit;

calculating a target position for the rotary valve as a function of an engine load, an engine speed and a desired engine inlet temperature, wherein the target position is defined in terms of a percentage of aperture of the rotary valve;

measuring the actual coolant flow rate delivered by the pump;

correcting the target position of the rotary valve as a function of a coolant flow rate delivered by the pump; and positioning the rotary valve into the target position to direct at least a portion of the coolant flow through the rotary valve to the radiator.

5. The method according to claim 2, further comprising;

measuring an engine inlet temperature; and correcting the target position of the rotary valve as a function of a difference between a target engine inlet temperature and the actual engine inlet temperature.

6. The method according to claim 2 further comprising:

measuring an engine inlet temperature;

correcting the target position of the rotary valve with a correction factor for the rotary valve determined as a function of a difference between a desired engine inlet temperature and the measured engine inlet temperature to obtain a corrected target position; and positioning the rotary valve with the corrected target position.

7. The method according to claim 6, wherein the correction factor of the rotary valve is implemented using a proportional-integrative control in which the coefficients of the proportional term and the integrative term are variable as a function of an engine operating condition.

8. The method according to claim 1, further comprising:
measuring an engine head temperature; and
correcting the target coolant flow rate to be delivered by the pump as a function of a difference between the desired engine head temperature and a measured engine head temperature.

9. The method according to claim 1, further comprising:
measuring an engine head temperature;
correcting the target coolant flow rate with a correction flow rate value determined as a function of a difference between a target engine head temperature and the measured engine head temperature to obtain a corrected flow rate value; and
operating the pump to deliver the corrected coolant flow rate.

10. The method according to claim 9, wherein the correction flow rate value is implemented using a proportional-integrative control in which the coefficients of the proportional term and the integrative term are variable as a function of at least one engine operating condition.

11. A non-transitory computer readable medium comprising a computer-code configured to executed the method according to claim 1.

12. A control apparatus for an internal combustion engine comprising an electronic control unit, and a computer-code stored on a non-transitory computer readable medium to executed the method according to claim 1.

13. An internal combustion engine comprising:
an engine block having at least one cylinder formed therein, a piston coupled to rotate a crankshaft supported on the engine block, and an engine head secured on the engine block which cooperates with the piston to define a combustion chamber;
a cooling system including a cooling circuit thermally coupled with the internal combustion engine and a pump configured to deliver a variable flow of coolant through the cooling circuit; and
an electronic control unit configured to:
store a target engine head temperature;
receive input signals indicating an engine speed and an engine load;
calculate a target coolant flow rate to be delivered by the pump as a function of the engine load, the engine speed and the target engine head temperature; and
operate the pump to deliver the target coolant flow rate.

14. The internal combustion engine of claim 13, wherein the cooling circuit comprises a rotary valve configured to direct a coolant flow through a radiator in the cooling circuit, and wherein the electronic control unit is further configured to:
calculate a target position for the rotary valve as a function of the engine load, the engine speed and the desired engine inlet temperature, wherein the target position is defined in terms of a percentage of aperture of the rotary valve; and
position the rotary valve into the target position to direct at least a portion of the coolant flow through the rotary valve to the radiator.

15. The internal combustion engine according to claim 14, wherein the electronic control unit is further configured to:
receive a signal indicating the actual coolant flow rate delivered by the pump; and
correct the target position of the rotary valve as a function of a coolant flow rate delivered by the pump.

16. The internal combustion engine according to claim 14, wherein the electronic control unit is further configured to:
receive a signal indicating the actual engine inlet temperature; and
correct the target position of the rotary valve as a function of a difference between a target engine inlet temperature and the actual engine inlet temperature.

17. The internal combustion engine of claim 14, wherein the electronic control unit is further configured to:
receive a signal indicating the actual engine inlet temperature;
correct the target position of the rotary valve with a correction factor for the rotary valve determined as a function of a difference between a desired engine inlet temperature and the measured engine inlet temperature to obtain a corrected target position; and
position the rotary valve with the corrected target position.

18. The internal combustion engine of claim 17, wherein the correction factor of the rotary valve is implemented using a proportional-integrative control in which the coefficients of the proportional term and the integrative term are variable as a function of at least one engine operating condition.

19. The internal combustion engine of claim 13, wherein the electronic control unit is further configured to:
receive a signal indicating the actual engine head temperature; and
correct the target coolant flow rate to be delivered by the pump as a function of a difference between the desired engine head temperature and a measured engine head temperature.

20. The internal combustion engine of claim 13, wherein the electronic control unit is further configured to:
receive a signal indicating the actual engine head temperature;
correct the target coolant flow rate with a correction flow rate value determined as a function of a difference between a target engine head temperature and the measured engine head temperature to obtain a corrected flow rate value; and
operate the pump to deliver the corrected coolant flow rate.

* * * * *